US006209877B1

(12) United States Patent
Warnick

(10) Patent No.: US 6,209,877 B1
(45) Date of Patent: Apr. 3, 2001

(54) BALL REBOUND DEVICE

(76) Inventor: Bruce D. Warnick, P.O. Box 22151, Knoxville, TN (US) 37933

( * ) Notice: Subject to any disclaimer, the term of this patent is extended or adjusted under 35 U.S.C. 154(b) by 0 days.

(21) Appl. No.: 09/220,093

(22) Filed: Dec. 23, 1998

(51) Int. Cl.[7] ..... A63B 63/00; F41J 1/00; F41J 3/00

(52) U.S. Cl. ..... 273/396; 273/395; 473/435

(58) Field of Search ..... 273/395, 396; 473/279, 518, 570, 435

(56) References Cited

U.S. PATENT DOCUMENTS

| | | | | |
|---|---|---|---|---|
| 3,229,976 | * | 1/1966 | Allen, Jr. | 473/570 |
| 3,341,201 | * | 9/1967 | Ryan | 473/518 |
| 3,427,026 | * | 2/1969 | Mahoney | 473/435 |
| 3,502,330 | * | 3/1970 | Cheftel | 273/395 |
| 4,613,133 | * | 9/1986 | Selberg et al. | 473/279 |
| 4,842,284 | * | 6/1989 | Rushing et al. | 273/395 |
| 5,857,679 | * | 1/1999 | Ringe et al. | 273/395 |
| 5,934,679 | * | 8/1999 | Strain et al. | 273/395 |

* cited by examiner

*Primary Examiner*—Jeanette Chapman
*Assistant Examiner*—M. Chambers

(57) ABSTRACT

An improved ball rebound device which will deliver a playground type ball such as a soccer ball, basketball, or kick ball which is propelled against the device, back to the user with surprising speed and distance. This ball rebound device utilizes a series of monofilament nylon elastic cords which are independently stung back and forth in a basket-weave fashion within a rectangular frame as a tennis racket is strung. This enables the device to more efficiently convert the kinetic energy of the ball into a powerful rebound back to the user. One embodiment of the device has within its frame the capability for adjustment of the tension of the cords to keep them operating at the desired tension. Another embodiment of the device has the capability for its frame to be adjustably oriented at various angles to the user to better suit the individual practice needs of the user.

16 Claims, 19 Drawing Sheets

BALL REBOUND DEVICE

BACKGROUND

1. Field of Invention

This device is an improved recreational practice device which will rebound a playground size ball such as a soccer ball, kick ball, or a basketball which has been propelled against the device.

2. Discussion of Prior Art

There have been many ball rebound devices previously patented which attempt to rebound a ball to the user who tosses or kicks a ball to the device. These devices may be each grouped into one of the following four categories. Reference the applicable patents in each category:

1) Pre-Woven fabric or net stretched taut within a frame,

| | | | | | |
|---|---|---|---|---|---|
| 3672672 | 3711092 | 4083561 | 4206916 | 4239235 | 4264070 |
| 4456251 | 4489941 | 4615528 | 4650189 | 4693472 | 4948147 |
| 5048844 | 5431411 | 5549304 | 5772537 | | |

2) Rigid rebound panel,

| | | | | | |
|---|---|---|---|---|---|
| 3752476 | 3836144 | 4093218 | 4258924 | 4421318 | 4588190 |
| 5054791 | 5524900 | 5556104 | | | |

3) Rigid rebound panel with springs, 4553751

4) Modified trampoline—stretched fabric or net within a spring assisted frame, 4119311 5007638

1) Pre-Woven fabric or net stretched taut within a frame: These devices rebound a ball which has been tossed, kicked or otherwise propelled to it by a simple pre-woven fabric or net which has been stretched across a frame. The rebound surface provided by this class of devices has a limited capacity for rebounding a ball with appreciable speed. This is believed to be due to the inherent design and construction of a net. For example, a net is primarily designed to "trap" or "stop" an object which strikes it. A net is a pre-woven assembly of stings which are sewn or connected with knots, usually in a zigzag pattern and usually has a perimeter routed cord or piece of fabric which is used to attach it to a frame. When impacted by the ball this zig-zag assembly of connected strings quickly dissipates the kinetic energy of the ball across the entire expanse of the net. This is why nets are excellent applications when used as backstops at baseball fields, batting cages, tennis courts, etc. No matter how taut a net is stretched, it still has a limited ability to efficiently rebound a ball due to its inherent design and construction. There are many types of materials and variations of nets. However, they all face the same severe limitation—they absorb and dissipate an appreciable amount of energy from the ball instead of efficiently storing and then re-administering the energy to the ball.

2) Rigid rebound panel: These devices each consist of large solid panels which serve as a backboard to rebound a ball which has been tossed or kicked to it. This is another simple approach to a ball rebound system. However, since the panels are solid and do not react at all in response to the ball, the rebound velocity depends largely upon the compression of the ball upon impact with the panel and the inherent tendency of the ball to quickly achieve the expanded condition. In other words, this class of devices takes an inactive role in the rebound of the ball upon impact.

3) Rigid rebound panel with springs: These devices are a modification of the rigid rebound panel in that springs have been attached to the rigid panel to provide some ability of the panel to absorb to energy from the ball upon impact of the ball and return energy to the ball as it is rebounded from the panel. This concept is a rudimentary improvement to the rigid panel ball rebound system, but the rebound velocity of the ball is still largely dependent upon compression of the ball and the inherent tendency of the ball to quickly return to its expanded condition. These devices may also contain other parts such as fasteners connecting the springs to the panel and a frame which inherently introduce undesirable friction into the ball rebound device.

4) Modified Trampoline: In this device, a pre-woven fabric is stretched taut within a frame by a series of springs around its perimeter. In this case, the fabric is usually inelastic, and depends primarily upon the springs to collect and re-administer the energy absorbed from the ball. Due to the fact that the fabric is relatively inelastic, and is largely an assembly of loosely woven strings, it tends to act in the same way as the net stretched taut within a frame. Much of the kinetic energy of the ball is quickly dissipated throughout the fabric as it is a pre-woven assembly of thread or string material—like the net, and therefore cannot re-administer the energy to the ball during the rebound. In some cases a net has been substituted for the fabric with springs attaching its perimeter to the frame.

OBJECTS, ADVANTAGES, AND SUMMARY

Accordingly, my ball rebound device has several objects and advantages:

It is an object of my ball rebound device to rebound a large playground ball such as a soccer ball, basketball, or kick ball propelled there-against by the user with increased speed and distance to enable the user to more quickly increase his ball handling skills. It is further an object of my ball rebound device to more efficiently utilize the kinetic energy of a playground size ball which strikes the device, so that the ball is rebounded from the device with a velocity not appreciably less than the velocity of the ball before impact, thereby providing the user with a more fruitful practice session with minimal effort.

My ball rebound device does not use a net, rigid rebound panel, nor a modified trampoline. My ball rebound device is able to rebound a playground size ball such as a soccer ball, basketball, or kick ball with higher speed and greater distance by the use of monofilament nylon cords which are individually strung taut within a frame. The cords are similar to tennis racket string. Each cord is preferably strung individually back and forth within the frame in a basket weave fashion—as a tennis racket is strung, enabling the device to convert a high percentage of the kinetic energy of the ball to a powerful rebound back to the user. By rebounding the ball back at a higher speed and for a greater distance, the user is provided with more challenging practice sessions in the skills of kicking, throwing, passing, catching, trapping and controlling the ball.

It is further an object of my ball rebound device to be easily oriented to a desired angle of orientation so that the ball will be rebounded back to the user at the desired angle and forward speed. The angle of orientation also provides the user flexibility depending on the type of ball used, and the skill for which the user wishes to practice.

In two of the three embodiments of the invention, the ball rebound device is able to rebound a playground type ball back to the user with a variety of angles and forward speeds. This is due to the ability of the device to be easily set at any one of several predetermined angles of orientation from vertical to a 45 degree reclined position. This flexibility allows the user to focus on practicing a variety of ball skills. This also enables users of different skill levels to have a productive practice session. For instance, a user with advanced ball skills would likely use the device in its vertical position to rebound the ball straight back with greater speed and distance. However, a user with lesser skills would likely use the device in a reclined position, which will rebound the ball back with some vertical angle (ie., more vertical angle translates to a slower forward speed) thus giving the novice user more time to react to catching or trapping the ball.

It is further an object of my ball rebound device to be quickly rolled to the desired location on a practice field or yard and quickly adjusted for use.

My ball rebound device is easily rolled from one practice location to another. To this end, my device has a roller assembly consisting of a pivoted mounted wheel on each side of the device which is easily engaged by one user to enable the user to move the device to the desired location. The wheel assembly is then easily disengaged to fix the device into position for use.

REFERENCE NUMERALS IN DRAWINGS

| | | |
|---|---|---|
| 1 | Vertical rigid structural members | (Angle iron or aluminum) |
| 2 | Horizontal rigid structural members | (Angle iron or aluminum) |
| 3 | Vertical adjustable tension members | (2" × 4" pressure treated member) |
| 4 | Horizontal adjustable tension members | (2" × 4" pressure treated member) |

-continued

| | | |
|---|---|---|
| 5 | Support base tube | (1-¼" electro-metallic tubing) |
| 6 | Support base tube | (1-¼" electro-metallic tubing) |
| 7 | Lower tube - Frame Adjustment Mechanism | (1-¼" electro-metallic tubing) |
| 8 | Upper tube - Frame Adjustment Mechanism | (1-½" electro-metallic tubing) |
| 9 | Control arm of Roller Assembly | |
| 10 | U-shaped rod to anchor support base to ground | |

DETAILED DESCRIPTION OF THE EMBODIMENTS

Figure 1:
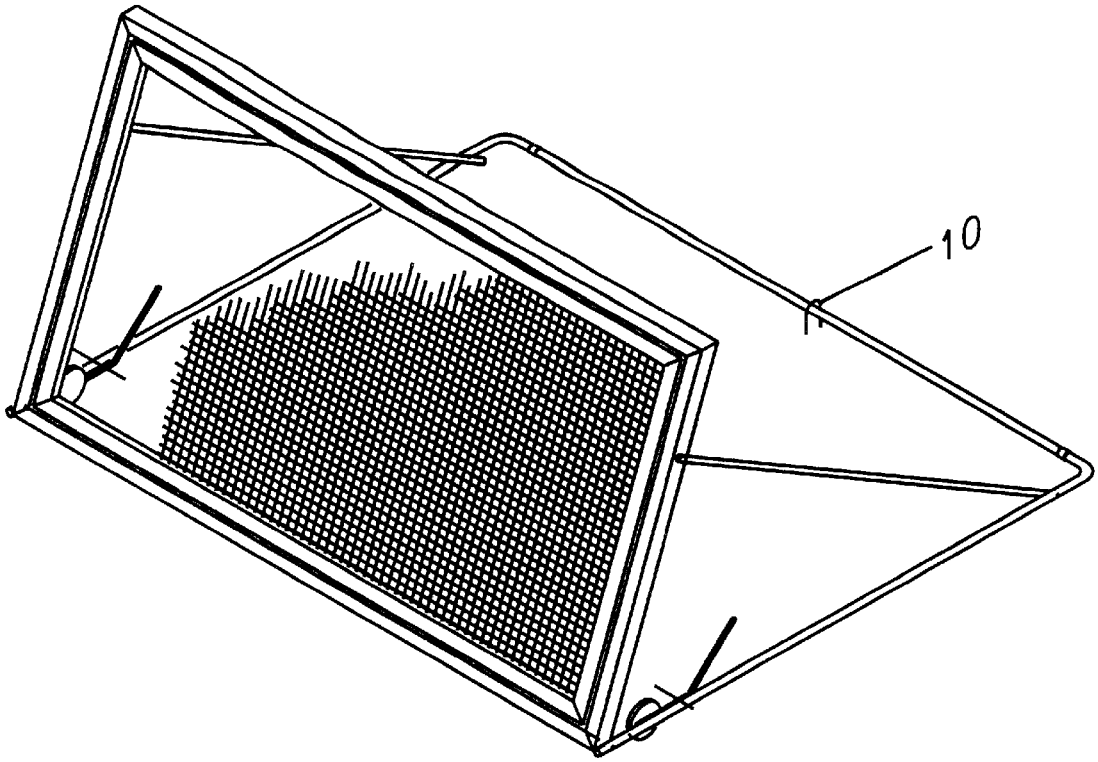
FIG. 1 shows an isometric view of a first embodiment of the ball rebound device

My rebound device is intended to be used with a playground type of ball (eg. soccer ball, kick ball, or basketball) which is relatively large in diameter (eg. at least eight inches in diameter), round, and inflated such that when it is propelled against a surface, it will compress and then suddenly return to its pre-compressed condition upon rebound from the surface. FIG. 1 shows a perspective view of a basic version of my ball rebound device. My ball rebound device has three major embodiments. The first embodiment consists of the frame assembly, the cord assembly, the support structure assembly, and the roller assembly.

Frame Assembly

Figure 2:
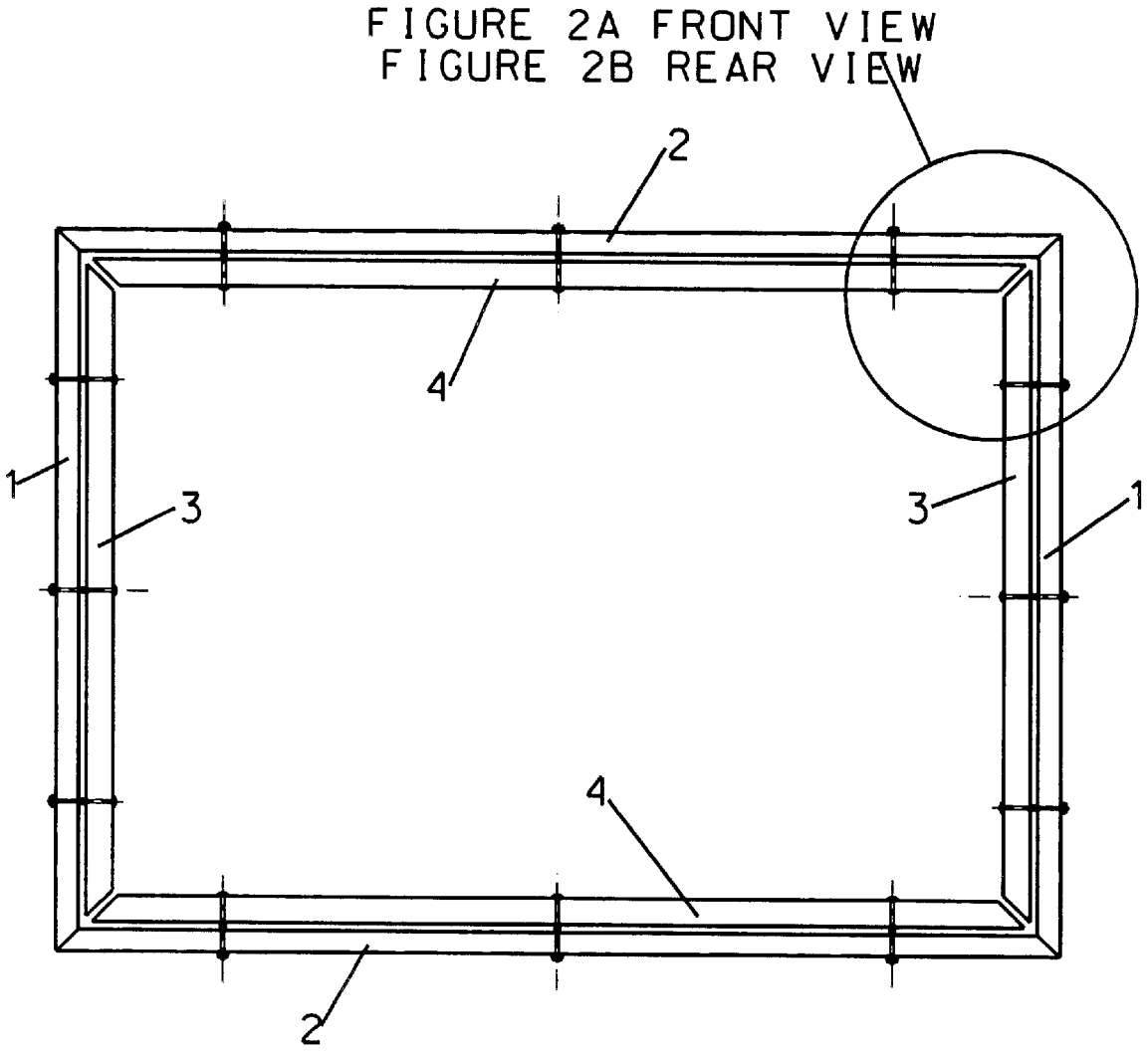
FIG. 2 shows the front view of the frame assembly of the FIG. 1 embodiment.

The Frame Assembly shown in FIG. 2, has two subcomponents: the rigid structural members—items #1 and #2, and the adjustable tension members—items #3 and #4.

Figure 2A:
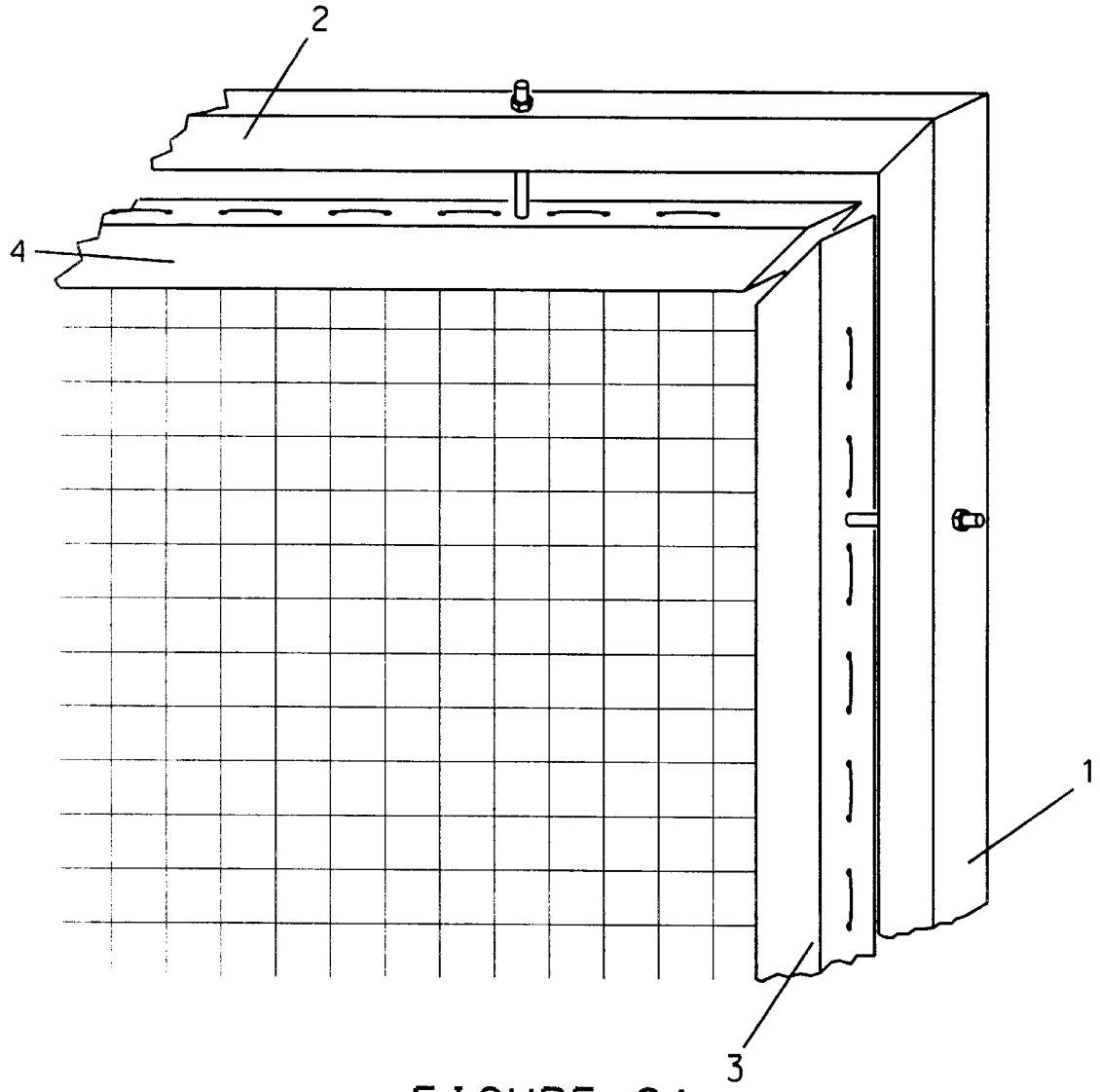
FIG. 2*a* shows an isometric view of the front corner detail of the components of the FIG. 2 frame assembly.
Figure 2B:
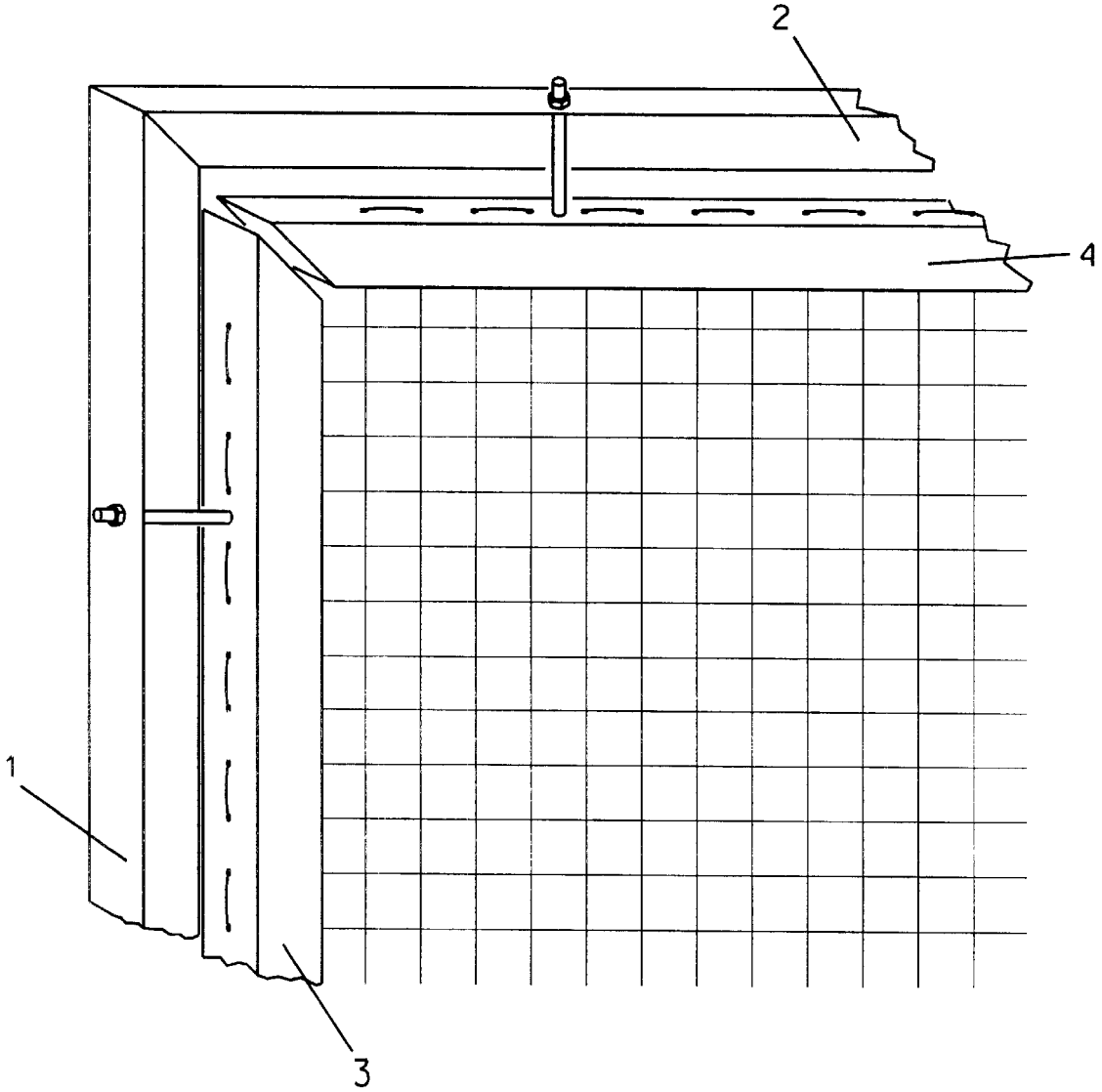
FIG. 2*b* shows an isometric view of a rear corner detail of the components of the FIG. 2 frame assembly.

The rigid structural members provide the overall strength for the frame assembly. They consist of four angle iron or aluminum structural shapes; two of which are vertical members on each side—items #1; and the other two are horizontal members on top and bottom—items #2. All four structural shapes are comprised of 3"×2"×3/16" angle iron or 4"×2"×¼" aluminum alloy. Each of the rigid structural members is mitred on each end, butted and welded at a 90 degree angle to its adjacent rigid structural member to form a rectangular frame measuring 12'-0" long and 8'-0" high. This is illustrated in FIGS. 2 and 2*a*. An alternative to the welded joint would be the use of a bolted-bracket type joint. Once the rigid structural members are joined together, three ½" diameter holes are drilled into the 2" leg of each member as shown in FIG. 2, and 2*b* for the purpose of attaching the adjustable tension members.

The adjustable tension members each consist of a single 2"×4" pressure treated length of lumber. An alternative material which is easily drilled and cut to shape may be substituted. FIG. 2*b* illustrates two of the four adjustable tension members, item #3 being the side member, and item #4 being the top member. This illustration is representative of each of the four corners of the frame with the adjustable tension members bolted to the rigid structural members. Each of the adjustable tension members is cut to a specific size to enable it to be located within the rigid support structure. In this version, the top and bottom horizontal adjustable tension members have an overall length of 11'-6". The two vertical side members have an overall length of 7'-6". The ends of each member are cut at a 45 degree angle. Each of the adjustable tension members has a series of 5/32" diameter through-holes drilled through it located 2" apart from one end of the adjustable tension member to the other end as shown in FIG. 2*b*. These through-holes are for the purpose of stringing the cord back and forth, from one tension member to the opposing tension member within the frame assembly. Each tension member also has three ½" diameter through-holes drilled as shown in FIG. 2, and 2*b*. A ½" diameter galvanized carriage bolt is inserted into each of these holes from the inside out and extends to the adjacent mating holes located in the rigid structural members. The bolts penetrate the rigid structural members and are fastened on either side of the 3/16" thick rigid structural members. FIG. 2*b* illustrates this attachment such that approximately 3" of space is left for drawing the tension member toward the structural member for purposes of tightening the cord. Once the tension members are located with respect to the rigid structural members, the two nuts on each through-bolt are tightened around the structural member to rigidly hold the tension member to the structural member in a fixed position.

Cord Assembly

Figure 3A:
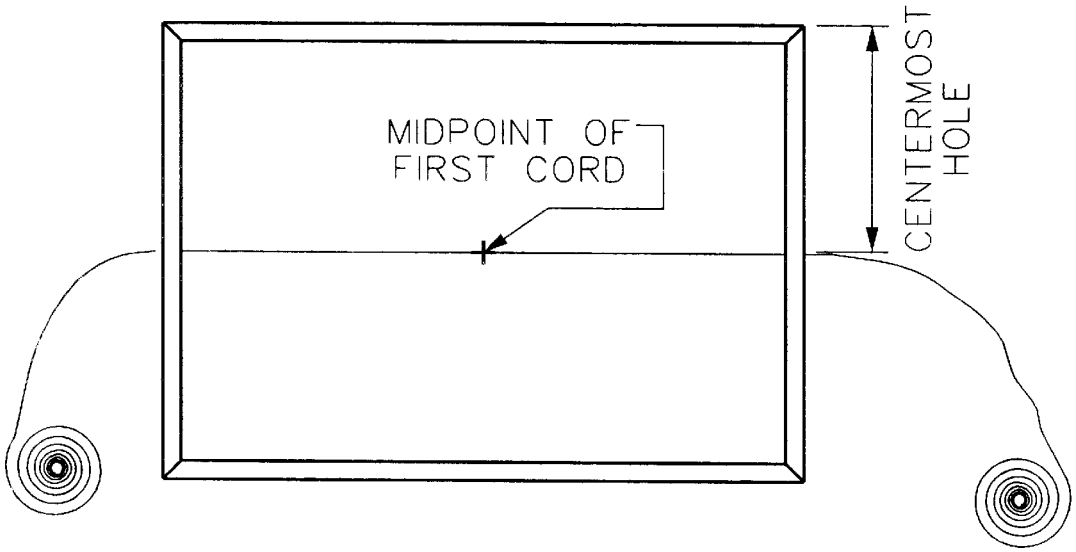
FIGS. 3*a*–3*g* show the step-by-step procedure for stringing the frame assembly.
Figure 3B:
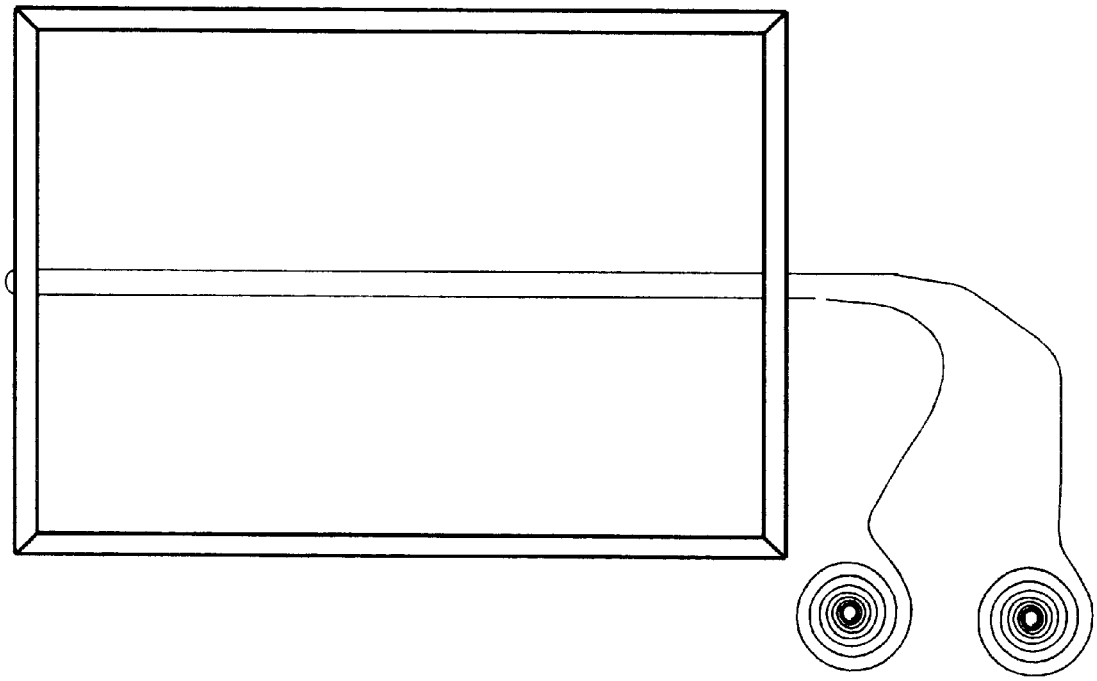
Figure 3C:
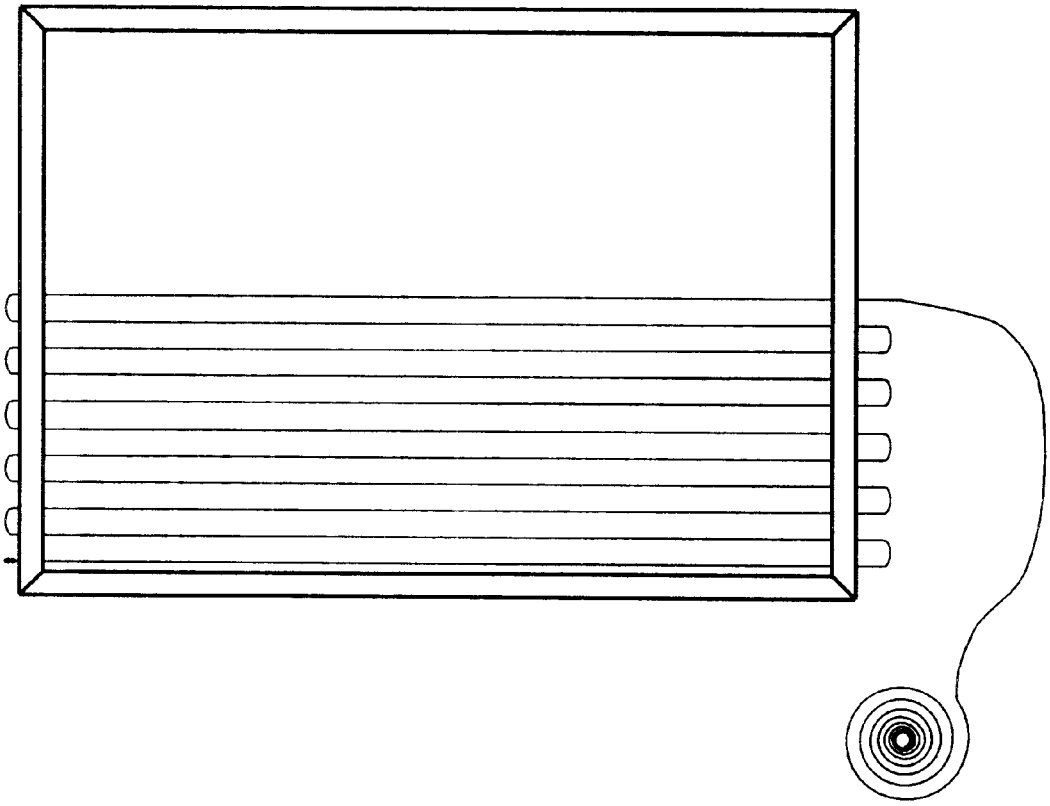
Figure 3D:
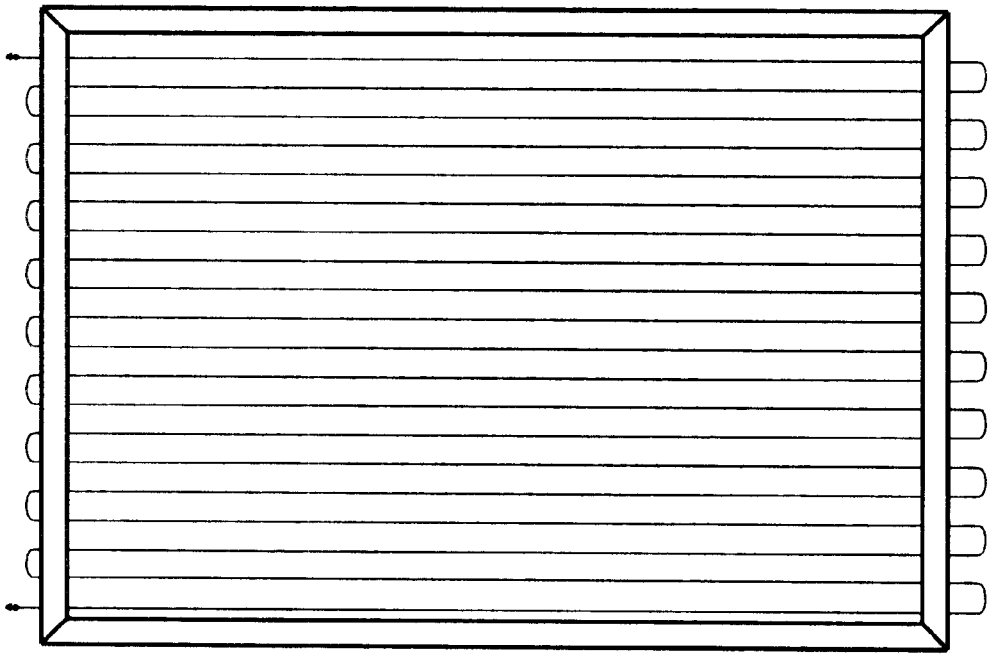
Figure 3E:
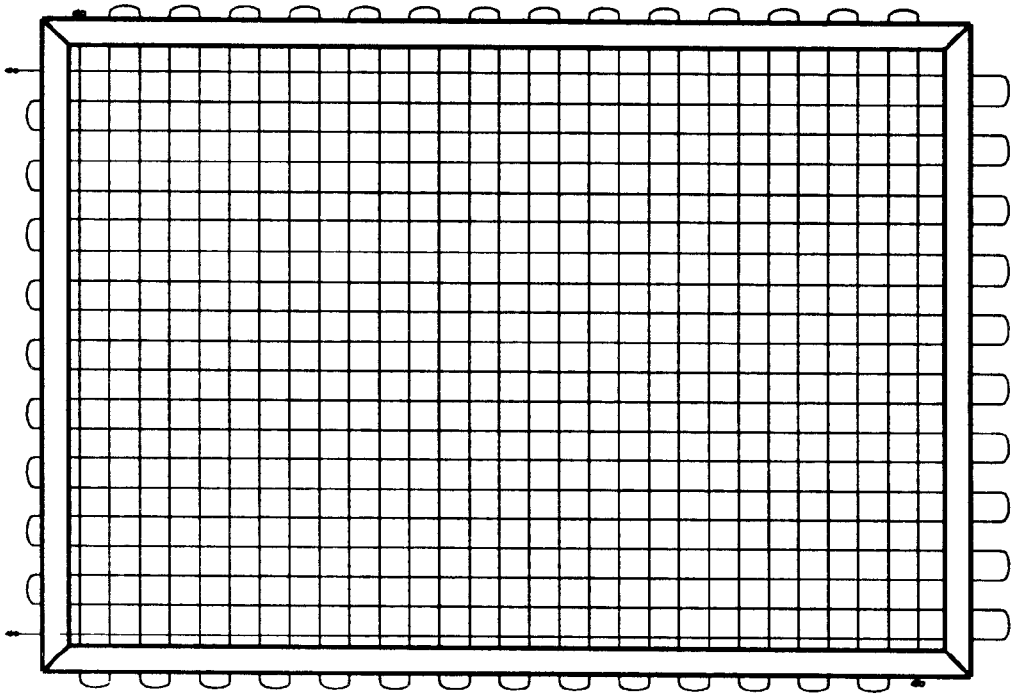
Figure 3F:
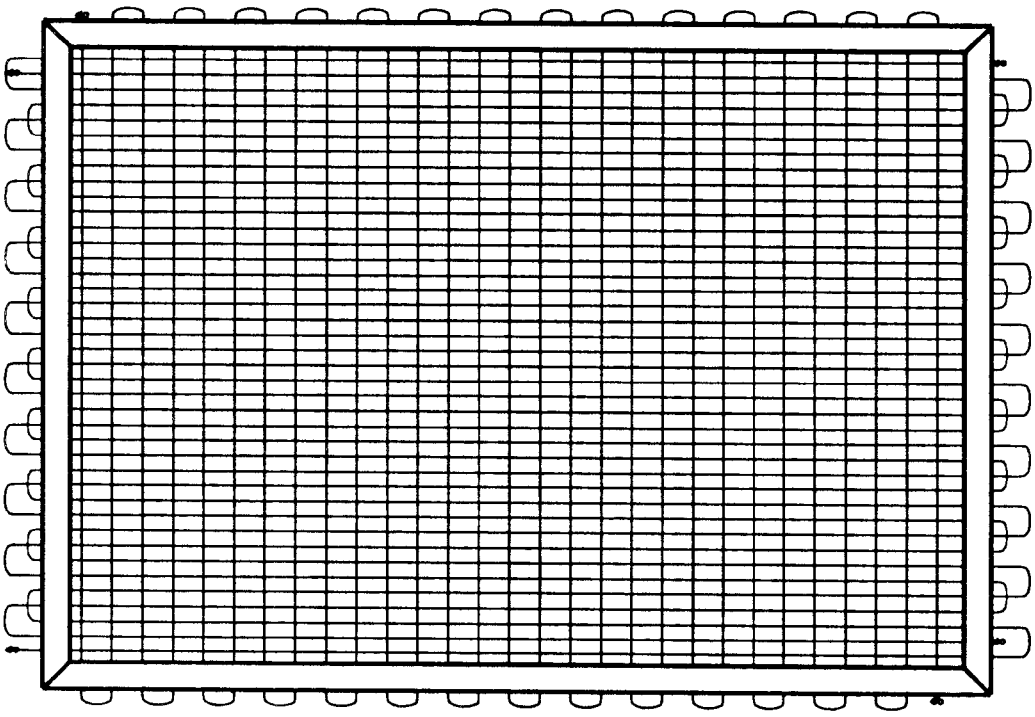
Figure 3G:
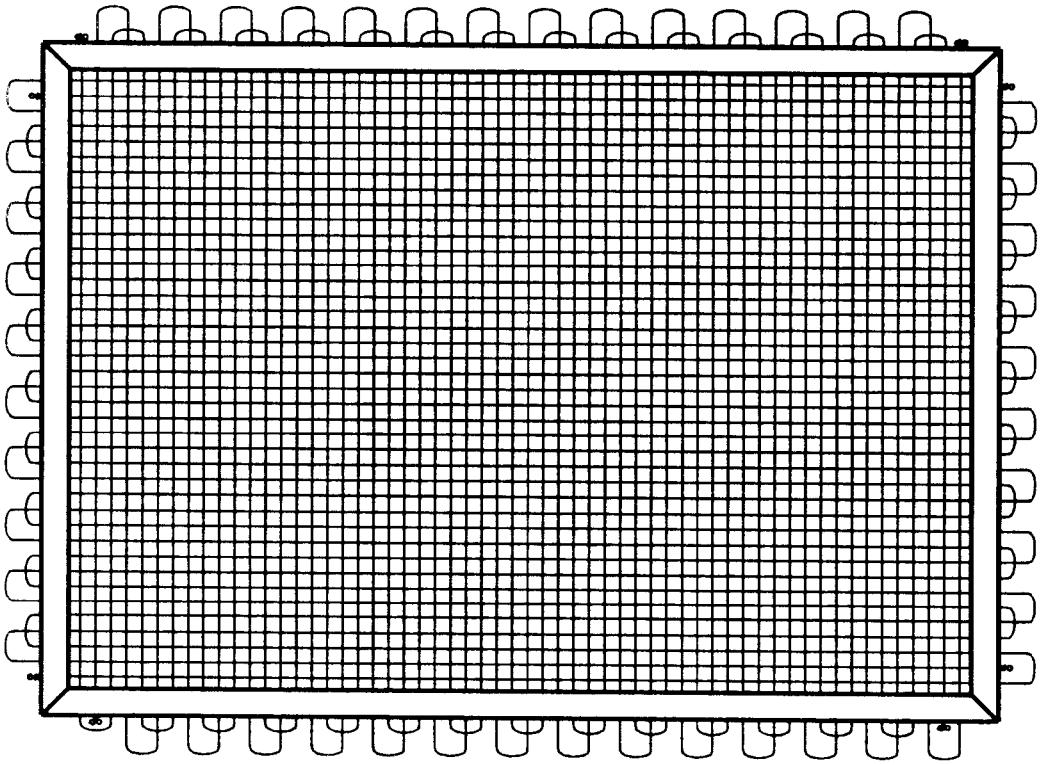

FIG. 3*g* illustrates the cord assembly consisting of a relatively large diameter (eg. 0.095 inches) nylon monofilament cord which is strung taut, back and forth between the adjustable tension members. Other diameters (eg. those between 0.05 inches and 0.20 inches) and materials may be substituted for the cord. However, mono-filament nylon cord offers the desirable strength and elasticity for rebounding the ball back to the user with little reduction in ball velocity. In this version, four cords are used to string the frame. Two are used in a vertical orientation and two are used in the horizontal orientation. FIGS. 3*a* through 3*g* illustrate the stringing procedure. The cord is strung by beginning at the center of one vertical tension member on the side of the frame, on the outside of the tension member, feeding the cord inward toward the tension member on the opposing side. The cord is pulled through both adjustable tension members until exactly one-half of the cord is pulled through the two vertical tension members. At this time, the remaining end of the cord which has not yet been pulled through is tied off to prevent it from being pulled further as shown in FIG. 3*a*. The cord is routed into the through-hole located 4" down on the opposing tension member (skipping the adjacent through-hole at the 2" location), and routed back through the through-hole and back to and through the opposing tension member until taut as shown in FIG. 3*b*. This same procedure is followed each time until the last hole in each of the opposing tension members is strung. A knot is tied at the end of the cord as it passes through the last through-hole as shown in FIG. 3*c* to hold the cord in position.

The remaining half of the cord which has been tied off, is untied and the same procedure is followed, routing the cord upwards on the two vertical tension members. When this cord is entirely strung into the tension member, exactly one-half of the through-holes in the two vertical tension members will have been strung as shown in FIG. 3*d*.

Using the same procedure a second cord is installed in the vertical direction between the top and bottom (horizontal) tension members. The cord is routed in front of the horizontal stringing which was just completed, as per FIG. 3*e*. The basket weave stringing procedure is not yet used at this point.

Using the same procedure a third cord is installed in the horizontal direction between the two vertical tension members. The through-holes which were left vacant when stringing the first cord are strung at this time. The cord is routed in the same location as done at the first step as shown in FIG. 3*f*. Again, the basket weave stringing procedure is not yet used at this point.

A fourth cord is installed in the vertical direction between top and bottom (horizontal) tension members. At this time, the through-holes which were left vacant when stringing the second cord are strung. The fourth cord is strung in a slightly different fashion than the first three cords. It is this cord which will be woven in a basket-weave fashion between cords already strung, as per FIG. 3*g*. When this cord is strung the cord assembly is complete and provides a planar impact surface against which a ball is expected to be propelled. Although the spacing between adjacent cords (or cord segments) in the woven arrangement is about two inches, alternative spacings (eg. between the range of one-half inch and three inches) is believed to be suitable for satisfactory operation.

Support Structure Assembly

Figure 4:
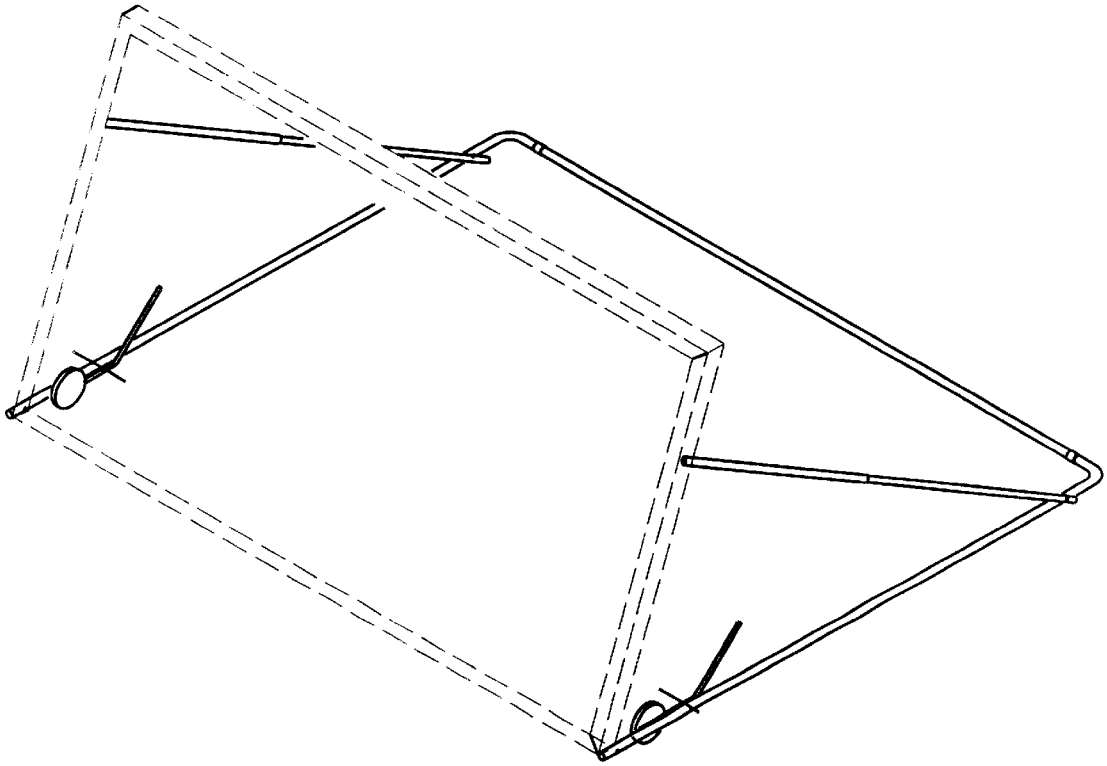
FIG. 4 shows an isometric view of the support structure assembly components of FIG. 1.

The support structure assembly consists of two sub-components: The support base, and the frame adjustment mechanisms of which there are two. FIG. 4 illustrates the support structure assembly and two sub-components in a perspective view.

Figure 4A:
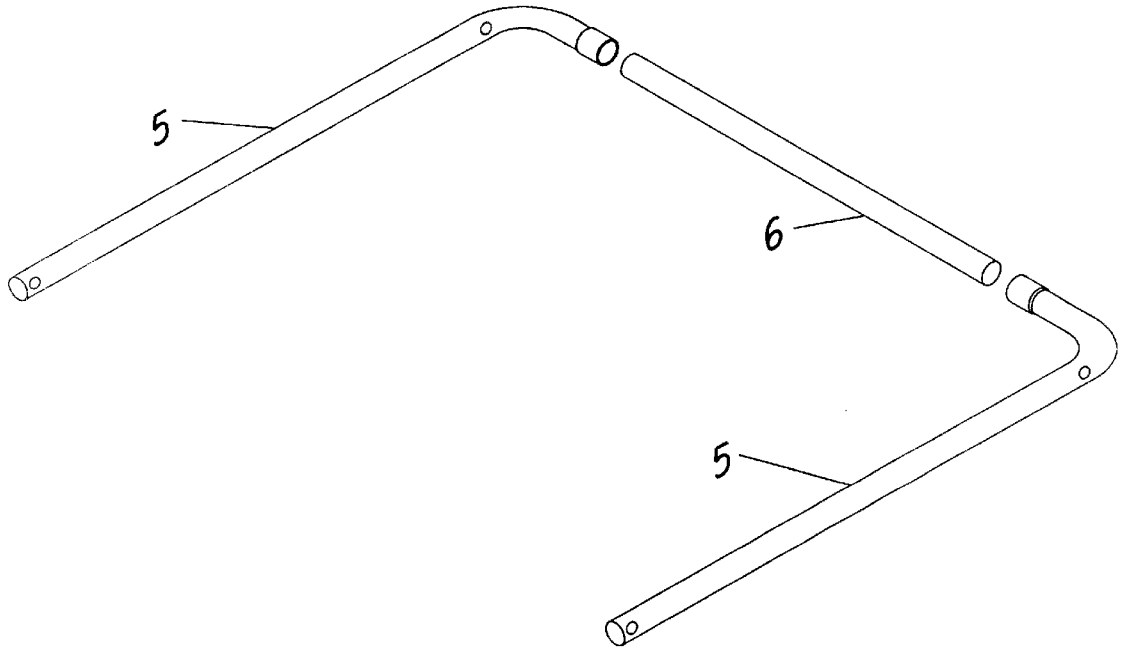
FIG. 4*a* shows an isometric view of the support base portion of the support structure assembly.
Figure 4B:
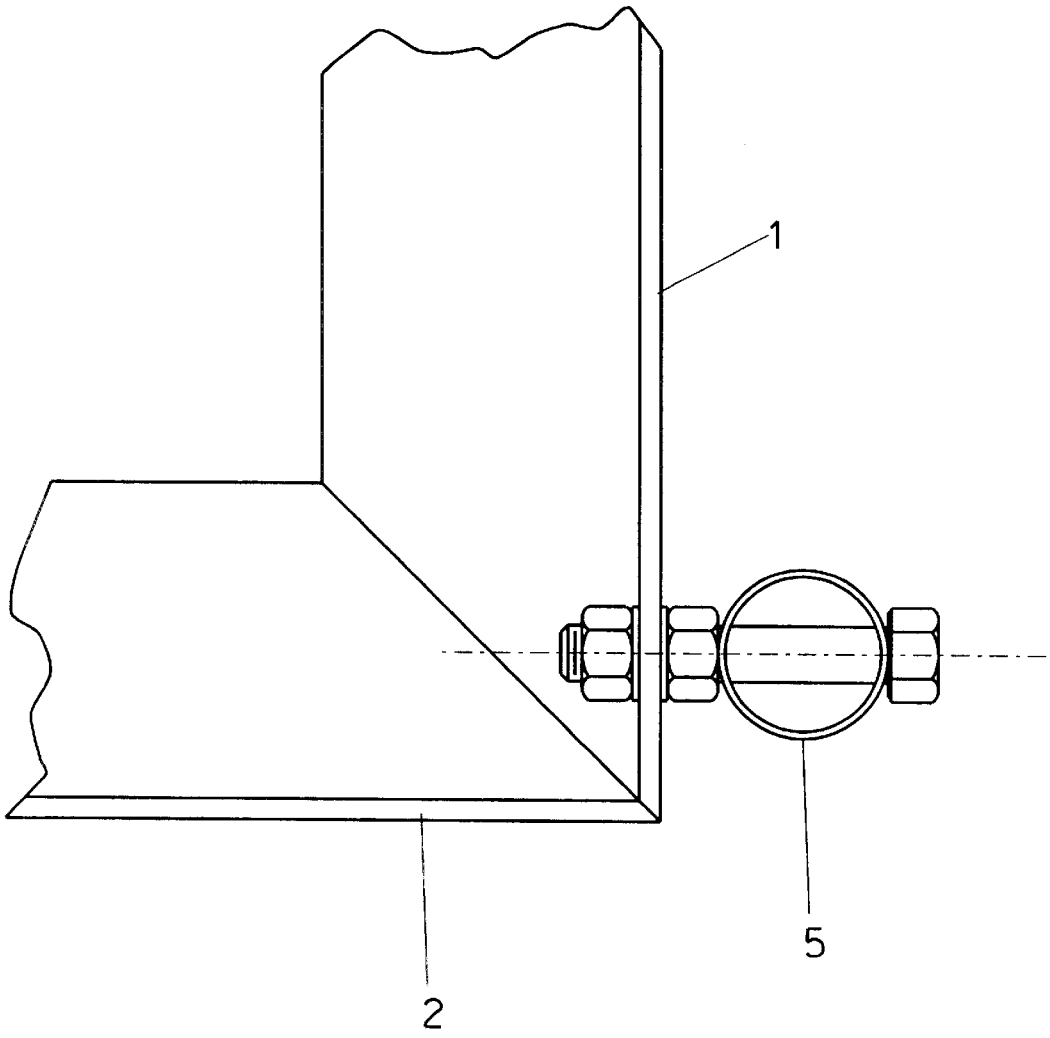
FIG. 4*b* shows a detail of the support base connection to the rigid structural member.

The support base is illustrated in FIG. 4*a*. It consists of three tubular members connected together in a U-shape. In this basic version, 1-¼" diameter electro-metallic tubing (EMT) is used for the tubular members. The two items #5 are drilled, bent and swaged as shown in FIG. 4*a*. The swaged ends of items #5 allow tube item #6 to be inserted into each swage and each joint is then locked into position with a single clevis pin and clip. FIG. 4*b* illustrates how the support base is connected to the rigid structural members with a ½" diameter×3" long hex bolt and nuts. This connection is representative of both sides of the structural frame.

Figure 4C:
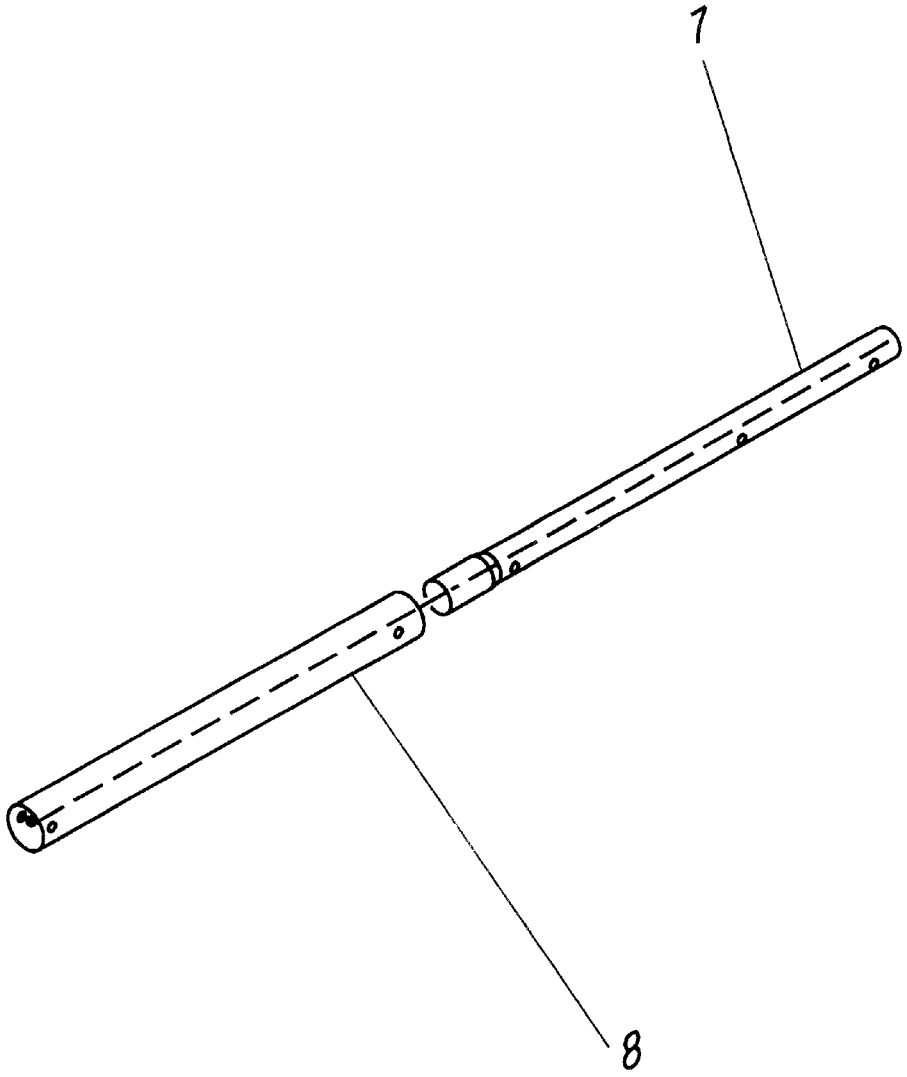
FIG. 4*c* shows an isometric view of the frame adjustment mechanism.

The frame adjustment mechanisms are illustrated in FIG. 4*c*. In this basic version, each mechanism consists of two EMT members: one 1-¼" diameter lower tube—part #7, and one 1-½" diameter upper tube—part #8. The lower tube is swaged on one end such that it slides into the upper tube snugly. The lower end of the lower tube is drilled to accept a ½" diameter clevis pin and clip which is connected to the support base toward the rear of the support base. The upper tube is drilled to accept a ½" diameter clevis pin and clip which is connected to the rigid structural member approximately 24" from the top of the structural frame. One of these frame adjustment mechanisms is located on each side of the structural frame as shown in FIG. 4.

Figure 4D:
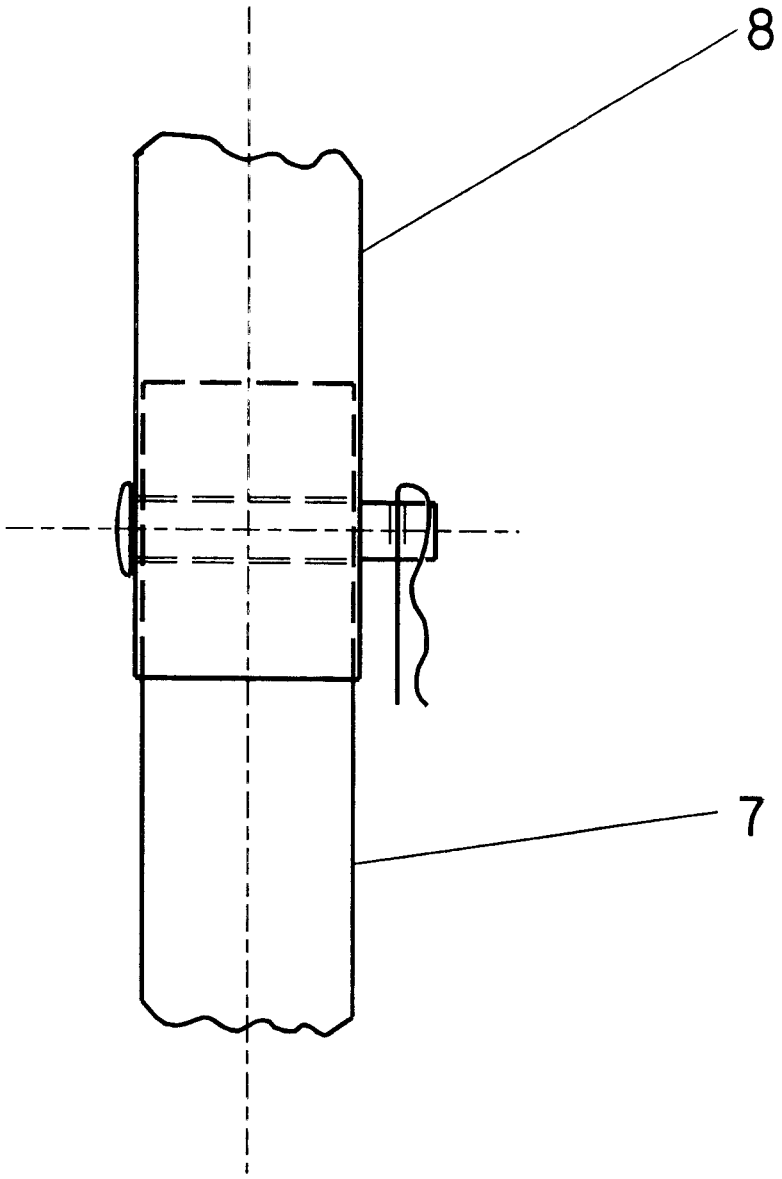
FIG. 4*d* shows a detail of the clevis locking pin in the frame adjustment mechanism.

Approximately 1" from the lower end of each upper tube, a ⅜" diameter hole is drilled as shown in FIGS. 4*c* and 4*d*. The frame is set in the vertical orientation and the position of each lower tube is marked at this drill location and a ⅜" diameter hole is drilled through each lower tube. The frame is then reclined to about a 65 degree angle orientation and a second ⅜" diameter hole is drilled through each lower tube, as shown in FIG. 4*c*. A clevis locking pin and clip are inserted into each of the adjustment mechanisms to lock them into position for the desired orientation. These two frame orientations represent the minimum required for the basic version of my device. Other frame orientations may be set up for the device by following this same procedure.

Each frame adjustment mechanism contains a 12' long piece of ⅛" aircraft cable which ties the fastened end of the lower tube to the fastened end of the upper tube. This cable ensures that the frame assembly will not overturn while the clevis pin has been removed to change the frame orientation.

Roller Assembly

Figure 5:
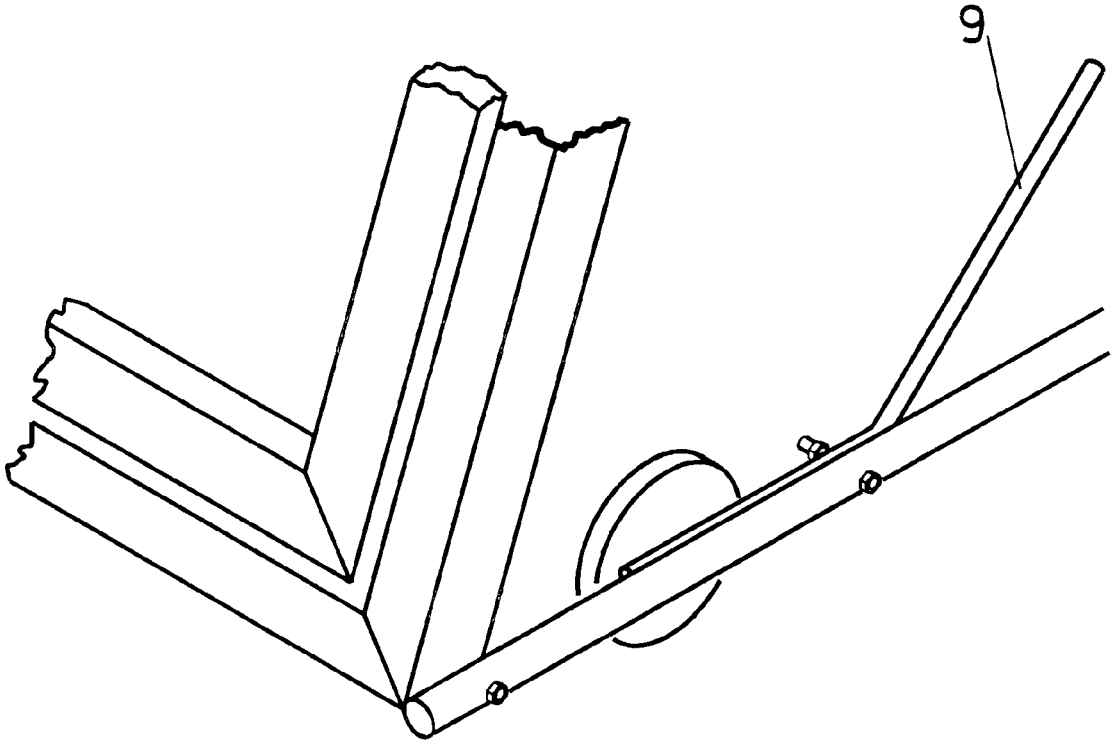
FIG. 5 shows an isometric view of the roller assembly.

There are two roller assemblies attached to the support base, one on each side near the structural frame as shown in FIG. 5. In this basic version, each roller assembly consists of a control arm which is a 60" length of EMT, item #9, which is drilled to accept a ½" diameter clevis pin and clip.

A ½" diameter mating hole is also drilled approximately 18" from the end of the support base. The control arm is then pinned to the support base with a ½" clevis pin and clip. A 8" diameter wheel is pinned to the control arm at the location shown in FIG. 5 with a clevis pin and clip.

Figure 1A:
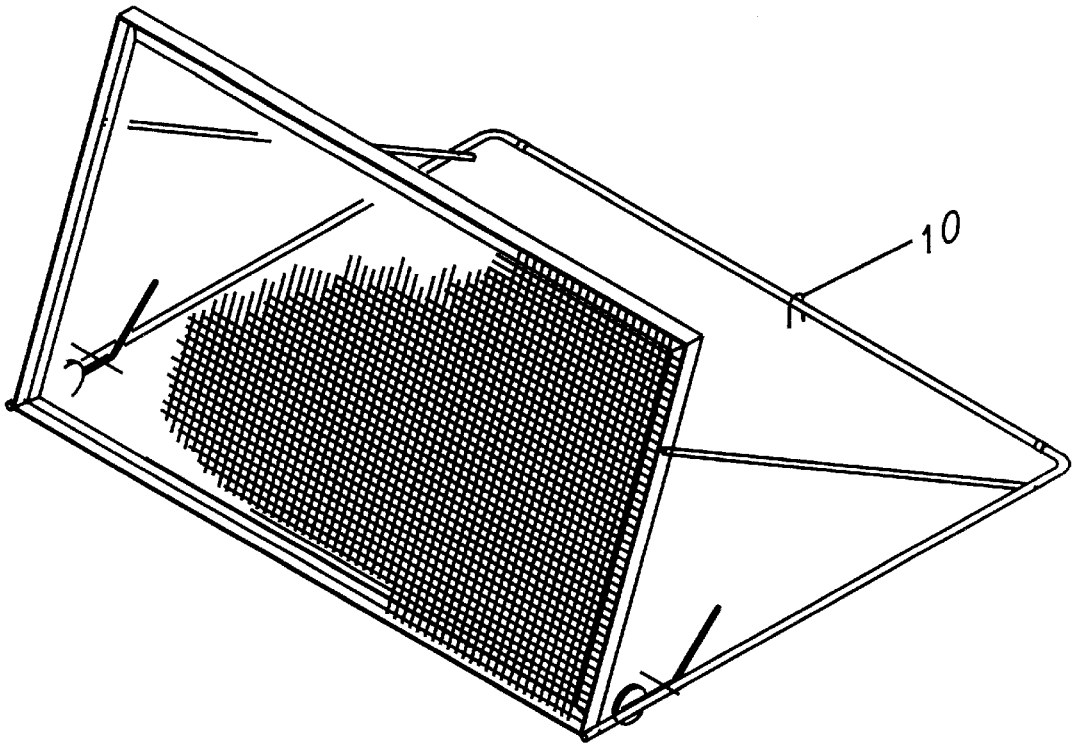
FIG. 1*a* shows an isometric view of a second embodiment; the ball rebound device of FIG. 1 shown without the adjustable tension members in the frame assembly.

In the second embodiment of the device shown in FIG. 1*a*, the tension members have been eliminated and the cords are strung between the four rigid structural members in the same fashion as described above under Cord Assembly. The four rigid structural members have been pre-drilled to accept the cords as did the tension members in the first embodiment. Once the four cords are individually strung, the desired tension is achieved by pulling and stretching each of the individual cord passes, where each cord pass gets tighter and tighter until all the cord passes have been pulled and stretched. Once the desired tension is achieved, the last knot is retied to retain the desired tension.

Figure 1B:
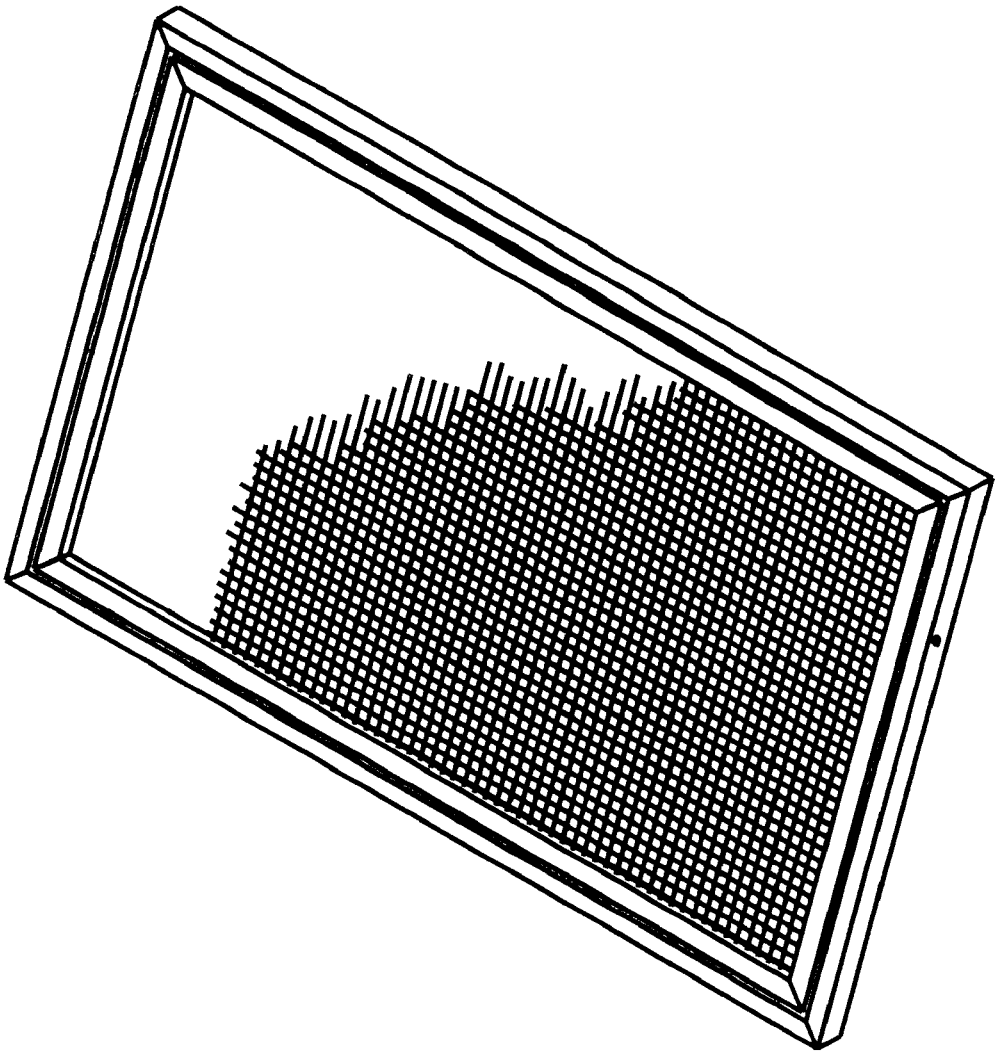
FIG. 1*c* shows an isometric view of a third embodiment; the ball rebound device of FIG. 1 shown without the support structure assembly.

In the third embodiment of the device shown in FIG. 1*b*, the support structure assembly has been eliminated to allow the frame assembly to be temporarily strapped to an existing soccer goal. In this embodiment, the frame assembly is identical to either of the two frame assembly embodiments described above. Once the frame assembly has been propped up against an existing goal, a set of four or six straps are strapped around the frame assembly and goal post to keep the frame assembly snug in a rigid condition against the goal so that the frame assembly is rigidly supported relative to the ground or other underlying support surface.

OPERATION OF BALL REBOUND DEVICE

The purpose of my ball rebound device is to enable the user to quickly increase his ball handling skills. The operation of this device will consist of many different types of practice sessions with users of varied skill levels, using any playground type ball such as a soccer ball, basketball, or a kick ball.

As a ball impacts the impact surface of the cord assembly, the elasticity of the tautly-strung cords contributes to the rebound velocity of the ball so that the rebound velocity of the ball is not appreciably less than the velocity of the ball immediately before impact with the impact surface. More particularly, during a phase of ball movement during which the ball impacts, and thereby suddenly presses against the impact surface, the cord segments disposed within the region of the impact are suddenly increased in length. However, the elasticity of the cord material inherently biases the cord toward an un-stretched (or pre-lengthened) condition so that as soon as the velocity of the ball is reduced to zero (corresponding to the greatest length to which the cord segments are stretched by the ball, the cord segments then return toward the un-stretched condition. This return of the impact-stretched cord segments toward the un-stretched condition is rapid so that the impact surface is urged forward against the ball in an action which throws the ball from the impact surface, and this throwing action actively contributes to the rebound velocity of the ball.

Since the playground type ball with which this device is expected to be used is inherently biased toward its pre-compressed condition following impact with the impact surface of the device, it is believed that the return of the ball to its pre-compressed condition while the impact surface throws the ball from the surface further enhances the rebound velocity of the ball. In other words, as long as the ball begins its return to a pre-compressed condition while the impact surface remains in contact with the ball during its throwing action, the ball and the impact surface collectively contribute to the rebound velocity of the ball.

There are three basic embodiments to this ball rebound device: embodiments 1 and 2 operate in the same manner. Embodiment 3 which consists of a frame assembly and a cord assembly only, must be attached to a separate support structure such as the posts of an existing soccer goal to establish a rigid mounting.

Setup

The first two embodiments contain their own support structure. This allows the device to be oriented in many angular orientations for a more versatile practice session. It is wise to first stake the support assembly to the ground with one or two ½"×18" rods bent in a U-fashion as shown in FIG. 1, item #10. This will ensure the device is stable and ready for rugged use. The user has at least two orientations of the frame from which to choose. A novice soccer user may choose to orient the frame in a reclining position as shown in FIG. 1*c*. The user would pull the clevis locking pins out of each of the adjustment mechanisms as shown in FIG. 4*d* and allow the frame to recline backwards until a pair of through-holes are aligned on the frame adjustment mechanisms. The clevis pins are then inserted into each adjustment mechanism to fix it into position.

Operation

The novice soccer user would stand an appropriate distance from the ball rebound device and kick a soccer ball against the taut, strung, impact surface of the device. Upon impact, the impact surface will throw the ball back to the user with surprising speed, and distance due at least in part, to the elastic nature of the individually strung cords. The user would attempt to trap the soccer ball as the user is taught in the game of soccer. After trapping the ball and controlling it back to the feet, the user would kick the ball back against the impact surface again, and repeat the procedure over and over. The user would attempt to kick the ball into the center of the impact surface, however, the surface is large enough to respond successfully to an off-center shot. The user may continue this practice session as long as the kicked ball strikes the impact surface.

The user (novice or advanced) may also wish to practice throwing, and passing ball skills. This is excellent practice for soccer players to increase their overhead throw-in skills. This is also good practice for basketball players to practice their passing skills. In either of these practice sessions, the user would stand an appropriate distance from the device and throw or pass the ball against the taut, strung, impact surface of the device. Again, the ball return device would rebound the ball back with surprising speed and distance. For the sport of soccer, this orientation also provides an excellent means to practice "heading-the-ball" skills. The user would first throw the ball against the impact surface of the device and when it returns in a slightly upward trajectory, the user uses his head to strike the ball back against the impact surface of the device. The user may continue these practice sessions as long as the thrown or headed ball strikes the impact surface of the device.

A more advanced soccer player would find the vertical frame position useful as shown in FIG. 8*b*. This is due to the nature of the vertical orientation to rebound the ball back in a more horizontal direction, thus requiring a higher degree of quickness and speed on the part of the user to catch or trap the ball successfully. The user would pull the clevis locking pins out of both frame adjustment mechanisms and push the frame up vertically until the locking pin holes are aligned, and then insert the locking pins into position. The user would then stand an appropriate distance in front of the ball rebound device and kick the ball against the taut, strung, impact surface of the device. The impact surface would rebound the ball back with surprising speed and distance. The user would attempt to trap the ball, control it to his feet and then kick the ball again against the impact surface. The user may continue this practice session as long as the kicked ball strikes the impact surface of the device.

The advanced user will also find the device useful for practicing long kicks such as corner kicks. In this practice session, the user would stand much further back from the device and kick the ball against the taut, strung, impact surface. The device will rebound the ball back to the user with surprising speed. The user may continue this practice session as long as the kicked ball strikes the impact surface. Again, the impact surface is large enough to give the user a large target in which to aim.

Since in the third embodiment, the frame must be temporarily attached to an existing support structure such as a soccer goal post, the operation of this embodiment is identical to the first two embodiments (vertical position only) discussed above.

Any person may re-locate my ball rebound device to another location. The temporary rods which were driven into the ground for additional stability must first be removed. The roller assembly is then engaged by pushing forward on the corresponding control arm such that the wheel is directed downward, thus lifting the device from the ground. The control arm is locked into place with a retainer attached to the frame. The same procedure is performed on the roller assembly and control arm located on the other side of the frame. At this point the frame is totally supported by the wheel assembly and ready to move. The device may then be rolled along the ground or underlying surface by pushing it from the rear. Two persons may also push the device, by pushing on each side of the frame. It follows from the foregoing that the control arms disposed at opposite sides of the frame provide a pair of lever bars which are pivotally connected to the frame and have an end to which a wheel is rotatably attached. By manipulating the end of each lever bar opposite the corresponding wheel so that the corresponding wheel is forced against the ground, the frame can be lifted to an elevated condition at which the device can be moved across the ground or underlying support surface as the wheels rollably engage the ground or underlying support surface. The retainer thus provides means for releasably locking the control arms in the manipulated condition at which the frame is elevated for movement across the ground or underlying support surface.

As is described in this section, this ball rebound device has a wide variety of uses for users of all skill levels interested in practicing their ball handling skills. Its unique quality of rebounding the ball back to the user with a rebound velocity which is not appreciably less than the impact velocity, enables and challenges the user to practice these skills to a high degree of accomplishment.

CONCLUSION, RAMIFCATIONS, AND SCOPE OF DEVICE:

Thus, the reader will see that this ball rebound device provides users of many different skill levels a highly challenging and realistic practice session in ball handling skills. This is due to the elastic, taut, strung, impact surface consisting of individually strung cords strung taut within a large frame, with its ability to rebound the ball back to the user with a rebound velocity not appreciably less than the impact velocity. In addition, the device may be oriented as desired by the user to the position which best suits the individual user's practice needs.

While my above description includes many specificities, these should not be construed as limitations on the scope of the device, but rather as an exemplification of three preferred embodiments thereof. Many other variations of each embodiment are possible. For example, the rigid structural frame members, may consist of many variations of materials, shapes, supports, methods of construction, and attachment as long as a frame with sufficient rigidity is provided. Another example is the adjustable tension members. Again, they may be substituted with other materials, shapes, sizes and methods of construction or even eliminated as one embodiment illustrates in FIG. 1*a*. Another example is the variations possible with the cord material and thickness. While I have described a nylon mono-filament cord having a diameter between about 0.05 inches to about 0.20 inches as my preferred material, many kinds and sizes of cord materials may exist which have the strength and elasticity to provide a suitable rebound surface. A fourth example is the method chosen for connecting the individual cords to the frame assembly. I have chosen to illustrate the 5⁄32" diameter through-holes in the frame assembly in which the cord is routed as my preferred method. However, any means of attaching the cords to the frame assembly could be equally adequate. A fifth example relates to the dimensions illustrated in this description. The dimensions could be larger or smaller and still contain all the necessary features mentioned in the claims. A sixth example is the method used for the support structure. In my first embodiment, many alternatives could be used to provide a firm foundation, and attachment to the frame assembly and still provide a means to adjust the orientation of the frame. My third embodiment does not use a self-contained support structure and allows the device to be supported by an existing support structure, such as an existing soccer goal.

Accordingly, the scope of my ball rebound device should be determined not by the embodiment(s) illustrated, but by the appended claims and their legal equivalents.

What is claimed is:

1. A ball rebound device for rebounding a playground size ball propelled against the device, the rebound device comprising:

a) a cord assembly including a first set of cord segments arranged in substantially parallel relationship with one another and a second set of cord segments arranged in substantially parallel relationship with one another, the first and second set of cord segments being woven together in a basket weave fashion so that the cord segments of the first set are disposed at substantially a right angle to the cord segments of the second set and so as to provide a substantially planar impact surface toward which a ball is expected to be propelled; and b) a generally rectangular frame having two pairs of opposite, spaced side members between which the first and second set of cord segments are tautly strung, wherein the cord segments of the first set of cord segments extend between the side members of one pair of side members so as to span the entire distance therebetween and wherein the cord segments of the second set of cord segments extend between the side members of the other pair of side members so as to span the entire distance therebetween, and each side member of the frame defines a plurality of through-holes arranged in a row which extends along the length of the side member and wherein the through-holes are arranged in the plane of the impact surface, and cord segments of the first set of cord segments are provided by a first single cord which is passed back and forth between the side members of one pair of side members in a series of passes across the frame so that at the end of each pass of the first single cord across the frame, the first single cord is routed through through-holes provided in a corresponding side member of the one pair of side members so that upon stretching the first single cord to a taut condition between the side members of the one pair of side members, each pass of the first single cord across the frame is anchored to the one pair of side members so that the length of the first single cord capable of being stretched by a ball which impacts the impact surface is equal to the spaced distance between the side members of the one pair of side members, and cord segments of the second set of cord segments are provided by a second single cord which is passed back and forth between the side members of the other pair of side members in a series of passes across the frame so that at the end of each pass of the second single cord across the frame, the second single cord is routed through through-holes provided in a corresponding side member of the other pair of side members so that upon stretching the second single cord to a taut condition between the side members of the other pair of side members, each pass of the second single cord across the frame is anchored to the other pair of side members so that the length of the second single cord capable of being stretched by a ball which impacts the impact surface is equal to the spaced distance between the side members of the other pair of side members, and so that when the frame is rigidly supported relative to the ground or other underlying support surface and a ball is propelled toward the impact surface, the rebound velocity of the ball is not appreciably less than the velocity of the ball before impact with the surface.

2. The device as defined in claim 1 wherein the cord segments in each of the first and second sets of cord segments are spaced a minimum of 0.5 inches apart.

3. The device as defined in claim 1 wherein the diameter of each cord segment is between 0.05 and 0.20 inches.

4. The device as defined in claim 3 wherein the diameter of each cord segment is about 0.095 inches.

5. The device as defined in claim 1 wherein the frame has a width and height with opposite sides spaced a distance of at least six feet apart.

6. The device as defined in claim 1 wherein the cord segments are comprised of a monofilament material.

7. The device as defined in claim 1 wherein one pair of side members of the frame includes a first set of opposite side members, and the segments of the first single cord which are passed back and forth between the side members of the first set provides the first set of cord segments, and wherein the other pair of side members of the frame includes a second set of opposite side members, and the segments of the second single cord which are passed back and forth between the side members of the second set provides the second set of cord segments.

8. The device as defined in claim 1 further comprising an adjustable support structure assembly for supporting the frame upon the ground or underlying support surface, the support structure assembly including an elongated brace member which is pivotally connected at one end to the frame and a support base positionable upon the ground and including an elongated telescoping arrangement whose length can be altered between two or more alternative lengths, and one end of the telescoping arrangement is pivotally connected to the frame and the other end of the telescoping arrangement is pivotally connected to the end of the brace member opposite the frame so that by arranging the telescoping arrangement in one of its alternative lengths, the impact surface is oriented at a 90 degree angle with respect to the ground and so that by arranging the telescoping arrangement in one of its other alternative positions, the impact surface is oriented at a position between the 90 degree angle and a 45 degree angle with respect to the ground or underlying support surface.

9. The device as defined in claim 8 wherein the support structure assembly is comprised of:

a) rigid members pivotally attached to the frame and attached to each other in such a manner as to provide a support structure portion which lays on the ground or underlying support surface, and b) a pair of adjustable mechanisms, each of which is pivotally attached on a corresponding side of the frame and includes two slidably coupled members which connect each corresponding side of the frame to the support structure portion which lays on the ground or underlying support surface and which can be adjusted in length by slidably adjusting the coupled members relative to one another so that by slidably adjusting the coupled members relative to one another, the angle of orientation of the frame relative to the ground or underlying surface is adjusted.

10. The device as defined in claim 8 further comprising a means for enabling the device to be relocated, the means being a) a pair of lever bars each having an upper and lower end, the lower end having an attached rotatable wheel and the upper end serving as a handle, and each lever being pivotably connected to the support structure on opposite sides thereof at a location between the upper and lower ends so that by manipulating the upper end of the lever bar the wheel is forced downward against the ground, so that the frame is lifted from the ground to an elevated condition at which the device can be moved across the ground or underlying surface as the wheels rollably engage the ground or underlying surface, and b) a means for releaseably locking the lever bar into a position at which the frame is elevated from the ground or underlying surface by the wheels.

11. The device as defined in claim 1 in combination with a round playground size ball having a diameter of at least eight inches.

12. A device for securement in a stationary condition for rebounding a ball which has been propelled to the device, comprised of:

a) a generally rectangular support arrangement having two opposing, spaced side members, and opposing, spaced top and bottom members, and b) a plurality of cords individually strung back and forth between the two opposing side members so that the cords span the spaced distance between the two opposite side members of the support arrangement and back and forth between the opposing top and bottom members of the support arrangement so that the lengths of cord which span the distance between the opposing side members and the lengths of cord which span the distance between the opposing top and bottom members cross one another in a basket weave fashion whereby a planar, taut, elastic, strung, impact surface is provided to rebound the ball back to the user, and each of the side, top and bottom members of the support arrangement defines a plurality of through-holes arranged in a row which extends along the length of the corresponding side, top or bottom member and wherein the through-holes are arranged in the plane of the impact surface, and each cord of the plurality of cords are passed back and forth between the opposing side members and the opposing top and bottom members of the support arrangement in a series of passes across the support arrangement so that at the end of each pass of the cord across the support arrangement, the cord is routed through through-holes provided in the corresponding side, top or bottom member of the support arranagement so that upon stretching the cord to a taut condition between the corresponding pair of opposing side members or opposing top and bottom members of the support arrangement, each pass of the cord across the support arrangement is anchored to the corresponding pair of opposing side members or opposing top and bottom members of the support arrangement so that the length of the cord capable of being stretched by the ball which impacts the impact surface is equal to the spaced distance between the corresponding pair of opposing side members or opposing top and bottom members of the support arrangement; and c) means for providing structural support for the taut impact surface wherein the support-providing means includes four rigid structural members which are connected together to form a rectangular frame which is disposed outboard of the support arrangement and further includes means for attaching the structural support-providing means to the support arrangement.

13. The device as defined in claim 12 further comprising a means for providing adjustment of the tautness of the impact surface wherein the adjustment-providing means includes:

a) headed fasteners which are disposed at selected locations around the perimeter of the frame wherein each fastener has a head and a shank which extends through a side, top or bottom member of the arrangement and the corresponding rigid structural member disposed adjacent to the side, top or bottom member of the arrangement, and b) a group of nuts wherein each nut is threadably secured upon the shank of a corresponding headed fastener so that the side, top or bottom member of the arrangement and the corresponding rigid structural member are captured between a nut and a head of a fastener and so that by tightening or loosening the nut about the shanks, the tautness of the impact surface can be adjusted.

14. The device as defined in claim 12 further comprising an adjustable support structure assembly for supporting the frame upon the ground or underlying support surface, the support structure assembly including an elongated brace member which is pivotally connected to one end of the frame and a support base positionable upon the ground and including an elongated telescoping arrangement whose length can be altered between one of several alternative lengths, and one end of the telescoping arrangement is pivotally connected to the frame and the other end of the brace member opposite the frame so that by arranging the telescoping arrangement in one of its alternative lengths, the impact surface is oriented at a 90 degree angle with respect to the ground and so that by arranging the telescoping arrangement in one of the other of its alternative lengths, the impact surface is oriented between a 90 degree angle and a 45 degree angle with respect to the ground or underlying support surface.

15. The device as defined in claim 14 wherein the support structure assembly is comprised of:

a) rigid members pivotably attached to the frame and attached to each other in such a manner as to provide a support structure portion which lays on the ground or underlying support surface, and b) a pair of adjustable mechanisms, each of which is pivotably attached on each side member of the frame, and consisting of two slidably coupled members which connect each corresponding side member of the frame to the support structure portion which lays on the ground or underlying surface, wherein the adjustable mechanisms enable for the frame to be adjusted and fixed to a desired angle orientation for use.

16. In combination:

a) a round, inflated playground ball having a diameter of at least eight inches and an inherent tendency to return to a normally-expanded condition when one of its sides is compressed upon impact with a surface, and b) a ball rebound device for rebounding the playground ball when the ball is propelled against the device, the rebound device including:

a cord assembly including a first set of monofilament cord segments arranged in substantially parallel relationship with one another and a second set of monofilament cord segments arranged in substantially parallel relationship with one another, the first and second sets of cord segments being woven together, rather than knotted, in a basket weave fashion so that the cord segments of the first set are disposed at substantially a right angle to the cord segments of the second set and so as to provide a substantially planar impact surface toward which a ball is expected to be propelled; and a frame having two pairs of opposing, spaced side members between which the first and second set of cords are tautly strung, wherein the cord segments of the first set extend between the side members of one pair of side members so as to span the distance therebetween and wherein the cord segments of the second set extend between the side members of the other pair of side members so as to span the distance therebetween, and each side member of the frame defines a plurality of through-holes arranged in a row which extends along the length of the side member and wherein the through-holes are arranged in the plane of the impact surface, and cord segments of the first set of cord segments are provided by a first single cord which is passed back and forth between the side members of one pair of side members in a series of passes across the frame so that at the end of each pass of the first single cord across the frame, the first single cord is routed through through-holes provided in a corresponding side member of the one pair of side members so that upon stretching the first single cord to a taut condition between the side members of the one pair of side members, each pass of the first single cord across the frame is anchored to the one pair of side members so that the length of the first single cord capable of being stretched by a ball which impacts the impact surface is equal to the spaced distance between the side members of the one pair of side members, and cord segments of the second set of cord segments are provided by a second single cord which is passed back and forth between the side members of the other pair of side members in a series of passes across the frame so that at the end of each pass of the second single cord across the frame, the second single cord is routed through through-holes provided in a corresponding side member of the other pair of side members so that upon stretching the second single cord to a taut condition between the side members of the other pair of side members, each pass of the second single cord across the frame is anchored to the other pair of side members so that the length of the second single cord capable of being stretched by a ball which impacts the impact surface is equal to the spaced distance between the side members of the other pair of side members so that when the frame is rigidly supported relative to the ground or other underlying support surface and the ball is propelled toward the impact surface so that one side of the ball impacts and thereby compresses against the impact surface, the rebound velocity of the ball is not appreciably less than the velocity of the ball immediately before impact with the impact surface.

* * * * *